US005560653A

United States Patent [19]

Beppu

[11] Patent Number: 5,560,653

[45] Date of Patent: Oct. 1, 1996

[54] DIETARY DISH

[76] Inventor: Yoshio Beppu, 4-3, Shimoigusa 1-chome, Suginami-ku, Tokyo, Japan

[21] Appl. No.: 319,794

[22] Filed: Oct. 7, 1994

[30] Foreign Application Priority Data

Oct. 14, 1993 [JP] Japan ..... 5-060266

[51] Int. Cl.[6] ..... B42D 15/00

[52] U.S. Cl. ..... 283/117; 40/324

[58] Field of Search ..... D7/551, 553, 555; 283/56, 117; 40/324

[56] References Cited

U.S. PATENT DOCUMENTS

| | | | |
|---|---|---|---|
| D. 118,377 | 1/1940 | Loveland | D7/551 |
| D. 178,588 | 8/1956 | Woodson | D27/106 |
| 2,764,005 | 9/1956 | Harris | D7/555 X |
| 2,861,367 | 11/1958 | Chanslor | 40/324 |
| 3,532,247 | 10/1970 | Bridges | D7/553 X |
| 4,275,518 | 6/1981 | Martin | 40/324 |
| 4,559,729 | 12/1985 | White | 283/117 X |
| 4,928,411 | 5/1990 | Danis et al. | 40/324 |

*Primary Examiner*—Willmon Fridie, Jr.

*Attorney, Agent, or Firm*—Birch, Stewart, Kolasch & Birch, LLP

[57] ABSTRACT

A dietary dish used for a person who must diet due to disease, such as diabetes, is disclosed. This dietary dish comprises at least one actual size photograph or detailed illustration of the foods to be served, printed on the bottom surface.

16 Claims, 6 Drawing Sheets

DIETARY DISH

BACKGROUND OF THE INVENTION

1. Field of the Invention

This invention relates to a dietary dish used for a person who must diet due to disease, such as diabetes.

2. Description of the Background Art

In advanced nations, people tend to be in a state of supernutrition, which results in geriatric diseases. This is a big social problem. Hypertension, gout, hyperlipemia, diabetes and the like are caused by supernutrition, which is a factor of risk. In particular, diabetes is easily caused and therefore a dietary cure is very important as a treatment.

In accordance with the dietary cure of diabetes, ingestible calories per day are determined by the degree of diabetes and the weight and exercise per day of the patient. The kind and amount of foods are then determined within the allowable calories so that nutrition is not lacking.

In daily meals, however, it is very difficult to keep to the allowable calories. That is, if the amount of a meal is carelessly decreased to keep to the allowable calories, some of the various nutritive elements are apt to be lacking. On the other hand, if a meal is freely taken as one pleases, the nutrition may be sufficient but the calories are over the limit. Thus, it is very difficult to have a balanced diet every day and to keep to the allowable daily calories in a dietary cure.

In order to reduce this difficulty, the Diabetes Society of Japan published a food exchange table whereby if the calories are the same, one food can be exchanged for other food in a given group. The table also gives some examples of standard daily meals.

However, even if model meals are shown in detail, it is very difficult to carry out every meal as a dietary cure. The difficulties of a dietary cure can be listed as follows.

1. A variety of foods must be taken so as not to create an imbalance among nutritive elements.
2. The standard meals are shown on the basis of weight, so that weighing is essential to keep to the allowable calories.
3. A person is carelessly apt to eat between meals, as a result of which the calorie intake is excessive.

A dietary cure is essential in the treatment of diabetes and it is also essential to stick to it. Even if diabetes is temporarily cured by the dietary cure, it will immediately take a turn for the worse unless the dietary cure is maintained. Thus, it is very important to overcome the above listed difficulties of the dietary cure.

The inventor, a medical doctor, knows how difficult it is to conduct a dietary cure and how important it is to maintain it. He has investigated the heart of this difficulty on the basis of his extensive medical experience and has found that the above three difficulties are particularly serious. Accordingly, the present invention has been accomplished on the basis of the understanding that if the foods to be taken so as not to create an imbalance among nutritive elements can be clear at a glance without consulting a book or a table every meal, and the foods can be served without the necessity of weighing, the above difficulties will be greatly reduced and it will be very easy to maintain a dietary cure. The object of the present invention is to provide a dietary dish used for a dietary cure, which can reduce the above difficulties.

SUMMARY OF THE INVENTION

In accordance with one aspect of the present invention, there is provided a dietary dish used for a person who must diet, comprising at least one actual size photograph or detailed illustration of the foods to be served, printed on the bottom surface.

According to the invention, "dish" means not only a glass, plastic or porcelain dish, but also a luncheon mat made of paper or plastic.

Preferably, the dietary dish indicates the number of calories and/or main nutritive components on the surface.

When foods to be served include liquid or paste, the inner wall of the dietary dish is preferably provided with a sign indicating the depth to be served.

In accordance with another aspect of the present invention, there is provided a dietary dish used for a person who must diet, comprising, in combination, printed matter on which at least one actual size photograph or detailed illustration of the foods to be served is printed, and a dish having a flat and transparent bottom whose size is the same as or larger than the actual size photograph or detailed illustration.

Preferably, the printed matter indicates the number of calories and/or main nutritive components.

When foods to be served include liquid or paste, the inner wall of the dish is preferably provided with a sign indicating the depth to be served.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 is a perspective view of yet another embodiment of a dietary dish which is a luncheon mat.

DETAILED DESCRIPTION OF THE INVENTION

Figure 1:
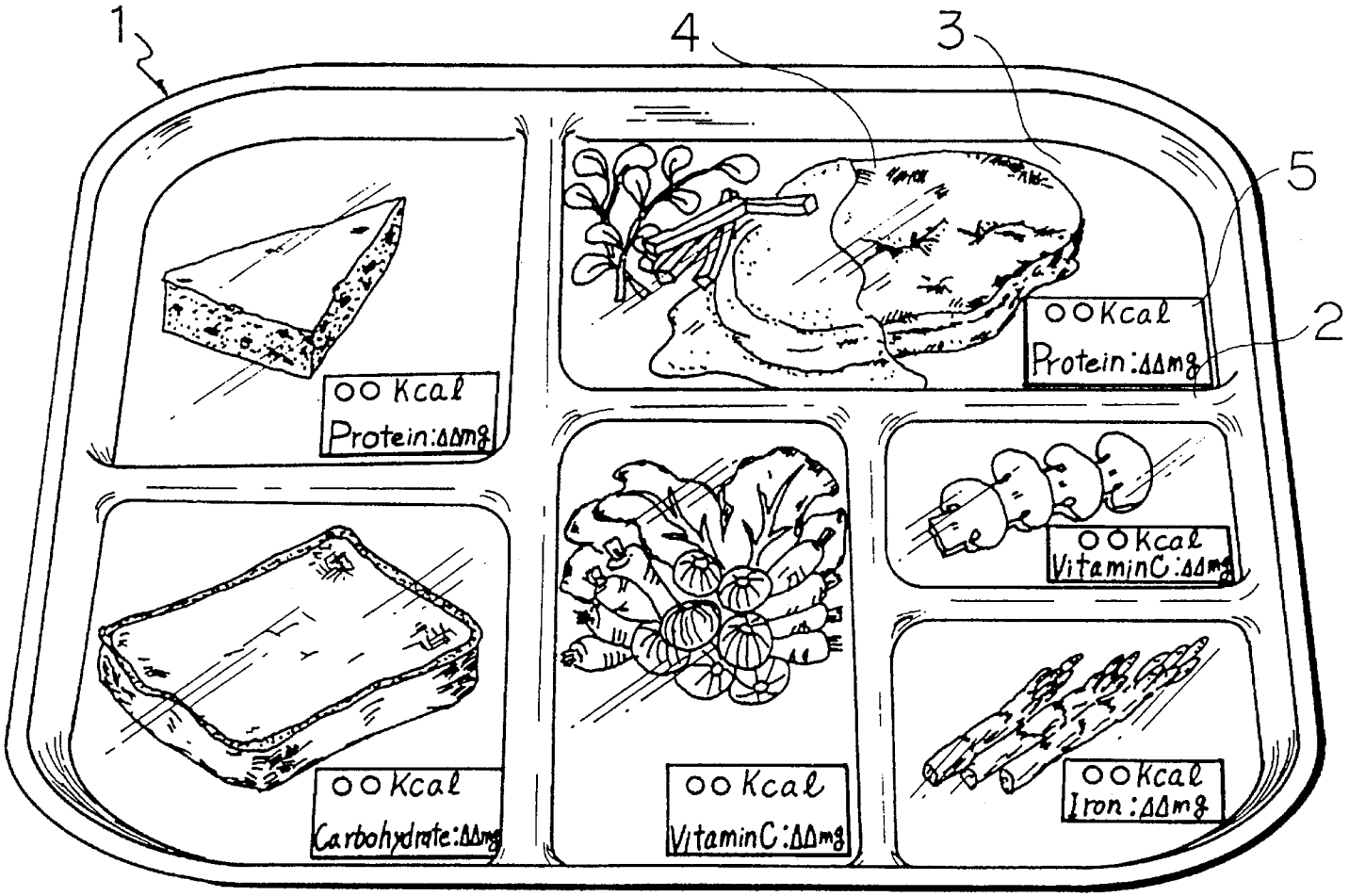
FIG. 1 is a perspective view of one embodiment of a dietary dish according to the present invention.

FIG. 1 shows a dietary dish 1 divided into six areas by partitions 2. On each part 3 to be served in individual areas are printed not only an actual size photograph or detailed illustration 4 of foods to be served, but also indications 5 of the number of calories and the main nutritive component.

In the embodiment illustrated in FIG. 1, all foods per meal are shown in one dietary dish. Therefore, when each food is directly served on the actual size photograph or detailed illustration so as to correspond to these sizes, the number of calories and the amount of the main nutritive component of the served foods automatically correspond to those illustrated.

Of course, the kind and size of the foods to be printed on a dietary dish depend on the kind and degree of the disease.

Figure 2A:
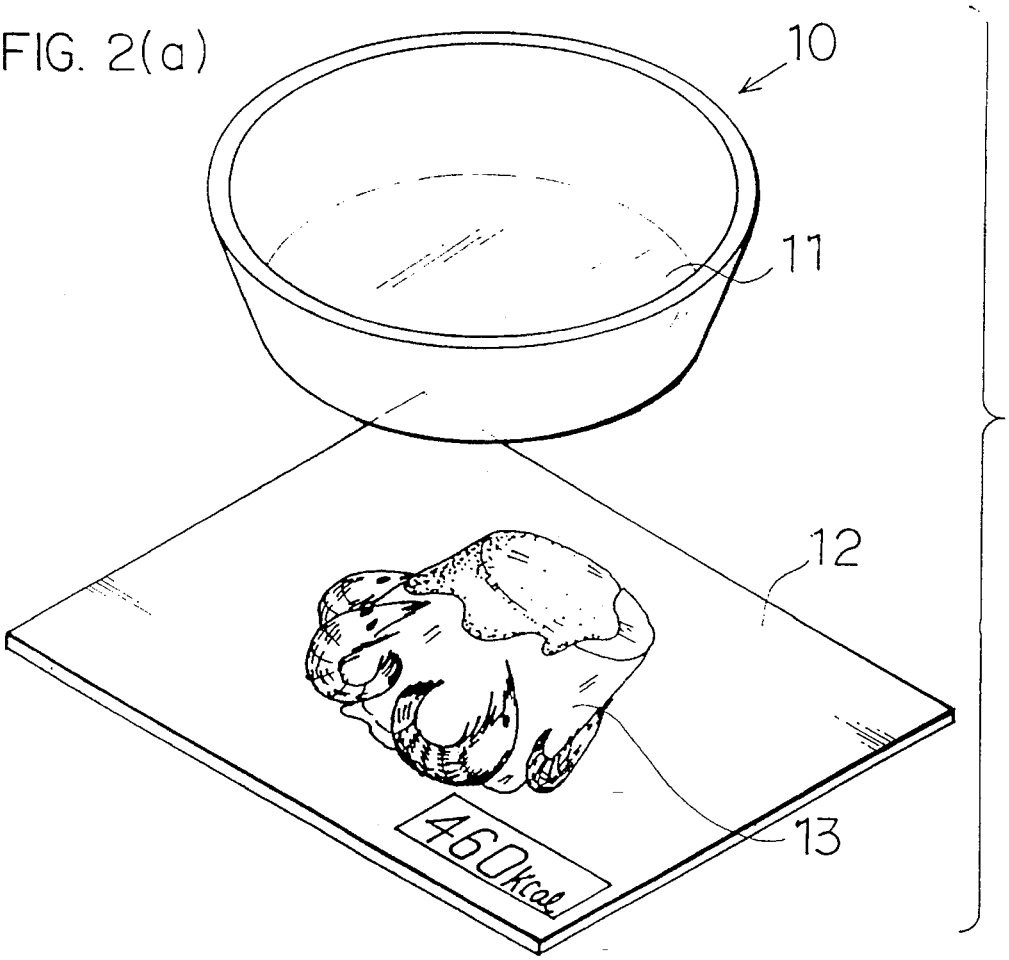
FIG. 2*a* is a perspective view of another embodiment of a dietary dish according to the present invention, comprising, in combination, printed matter and a dish having a flat and transparent bottom.
Figure 2B:
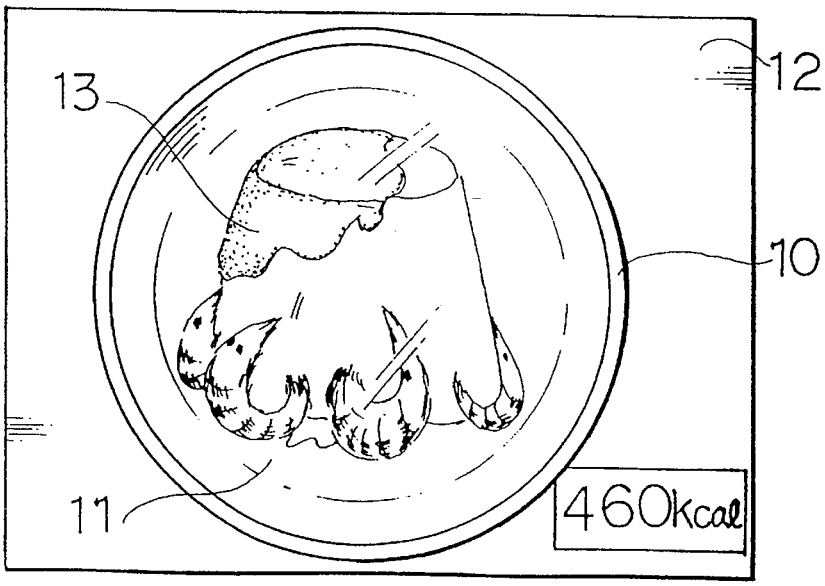
FIG. 2*b* is a plan view of the dietary dish illustrated in FIG. 2*a*.

Referring to FIG. 2*a*, a dish 10 to be served has a transparent bottom 11, the surface of which is sufficiently large that when this dish is set on printed matter 12 on which an actual size photograph or detailed illustration 13 of foods is printed, it is fully covered as shown in FIG. 2*b*. In this case, it is not necessary to cover the indication of number of calories.

As long as the bottom of the dish 10 is transparent, the material need not be restricted to glass and, for example, may be a synthetic resin. Further, the material of the printed matter 12 is not restricted to paper, but is preferably of water-resistant plastic.

Figure 3:
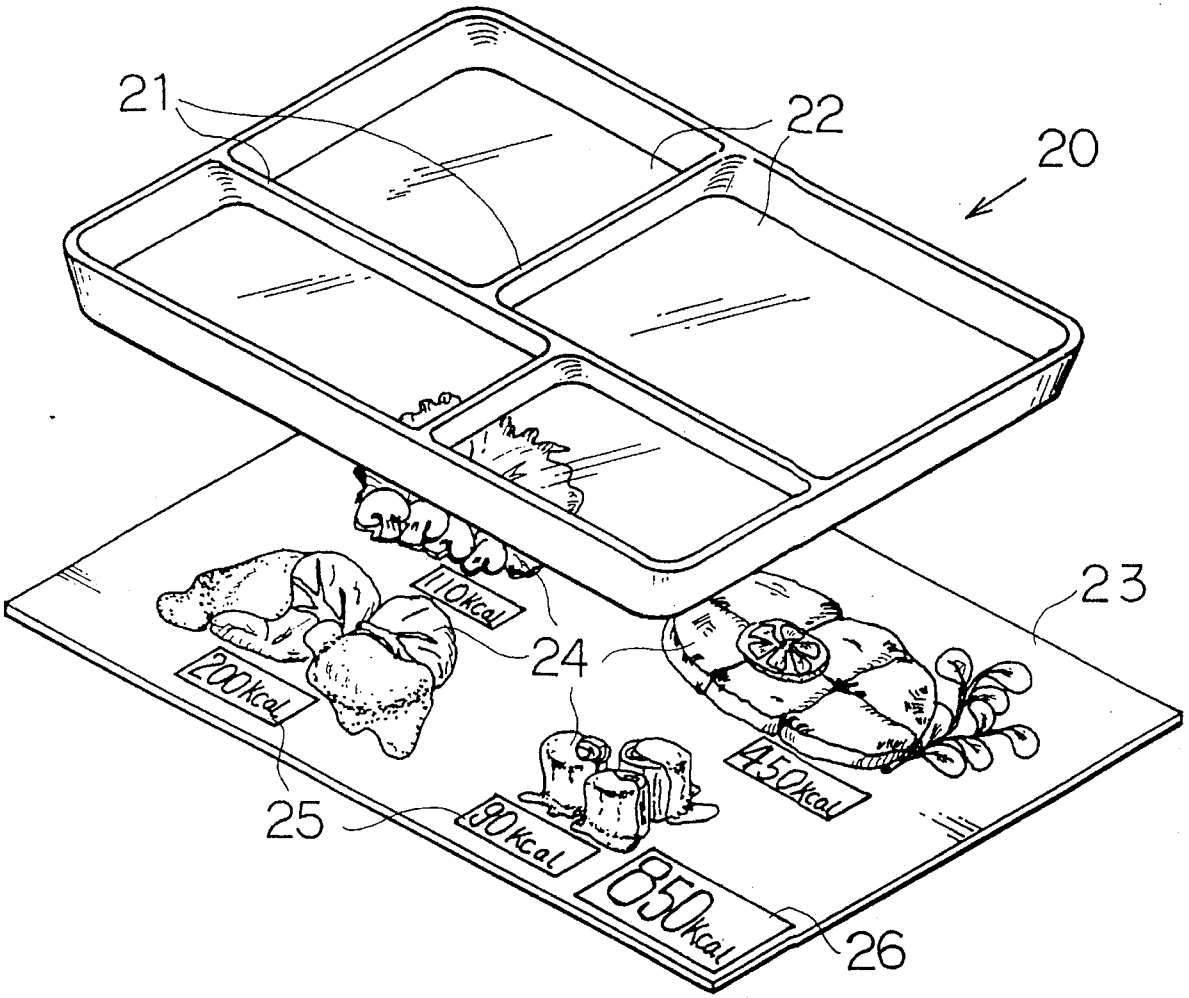
FIG. 3 is a perspective view of still another embodiment of a dietary dish according to the present invention, comprising, in combination, printed matter and a dish having a flat and transparent bottom.

Referring to FIG. 3, a dish 20 is divided into four areas by partitions 21, the bottoms 22 of each area being transparent.

Actual size photographs or detailed illustrations 24 of foods and indications 25 of the number of calories thereof are printed on the portions corresponding to the above areas in printed matter 23 made of plastic sheet. Further, an indication 26 of the entire number of calories is printed on the corner of the printed matter 23.

The dish 20 is set on the printed matter 23 and foods are served so as to correspond to the actual size photographs or detailed illustrations 24 of foods, with the result that it is possible to take the necessary amount of food per meal without weighing.

Figure 4:
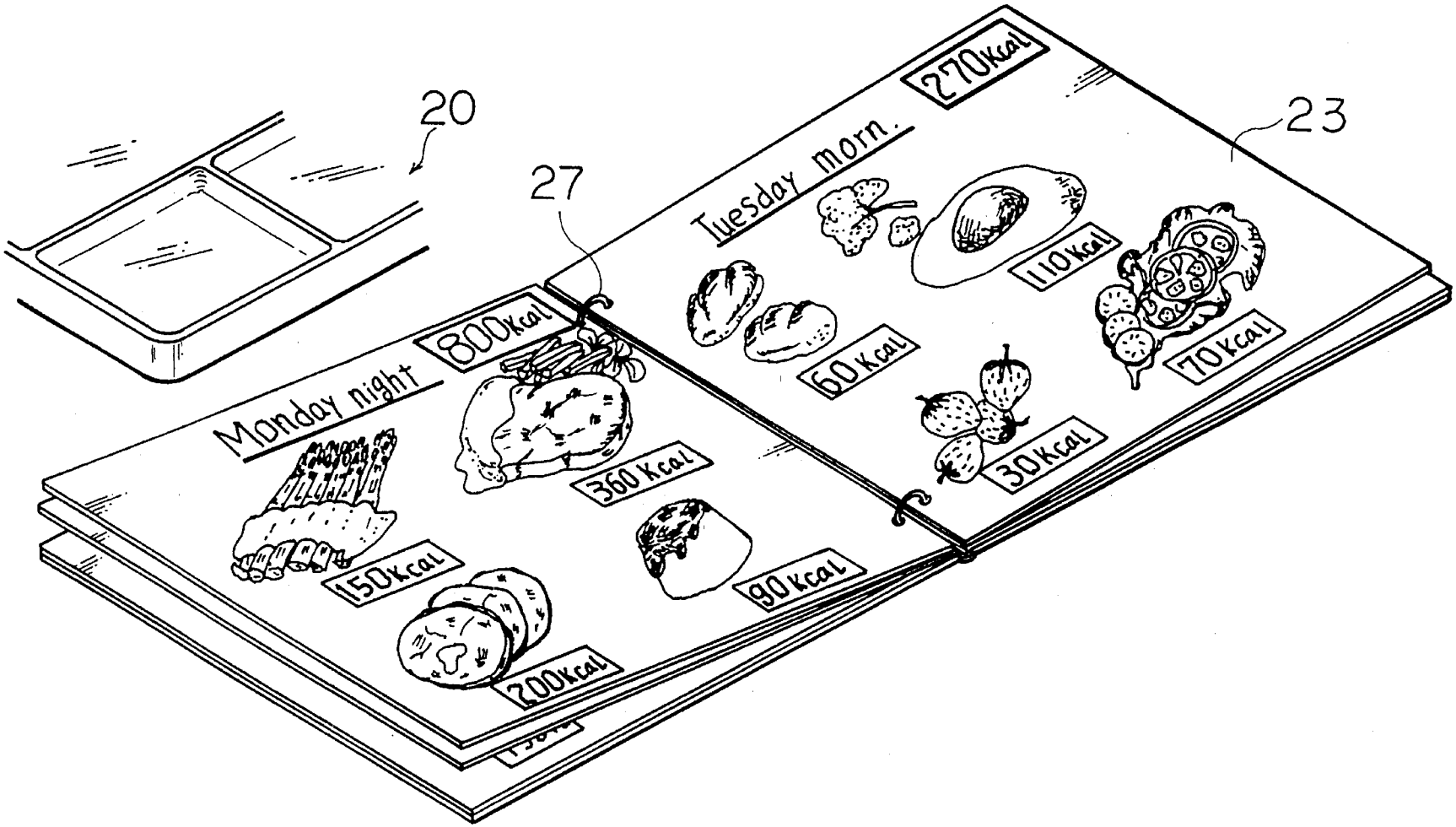
FIG. 4 is a perspective view of another embodiment of the printed matter illustrated in FIG. 3.
Figure 4:
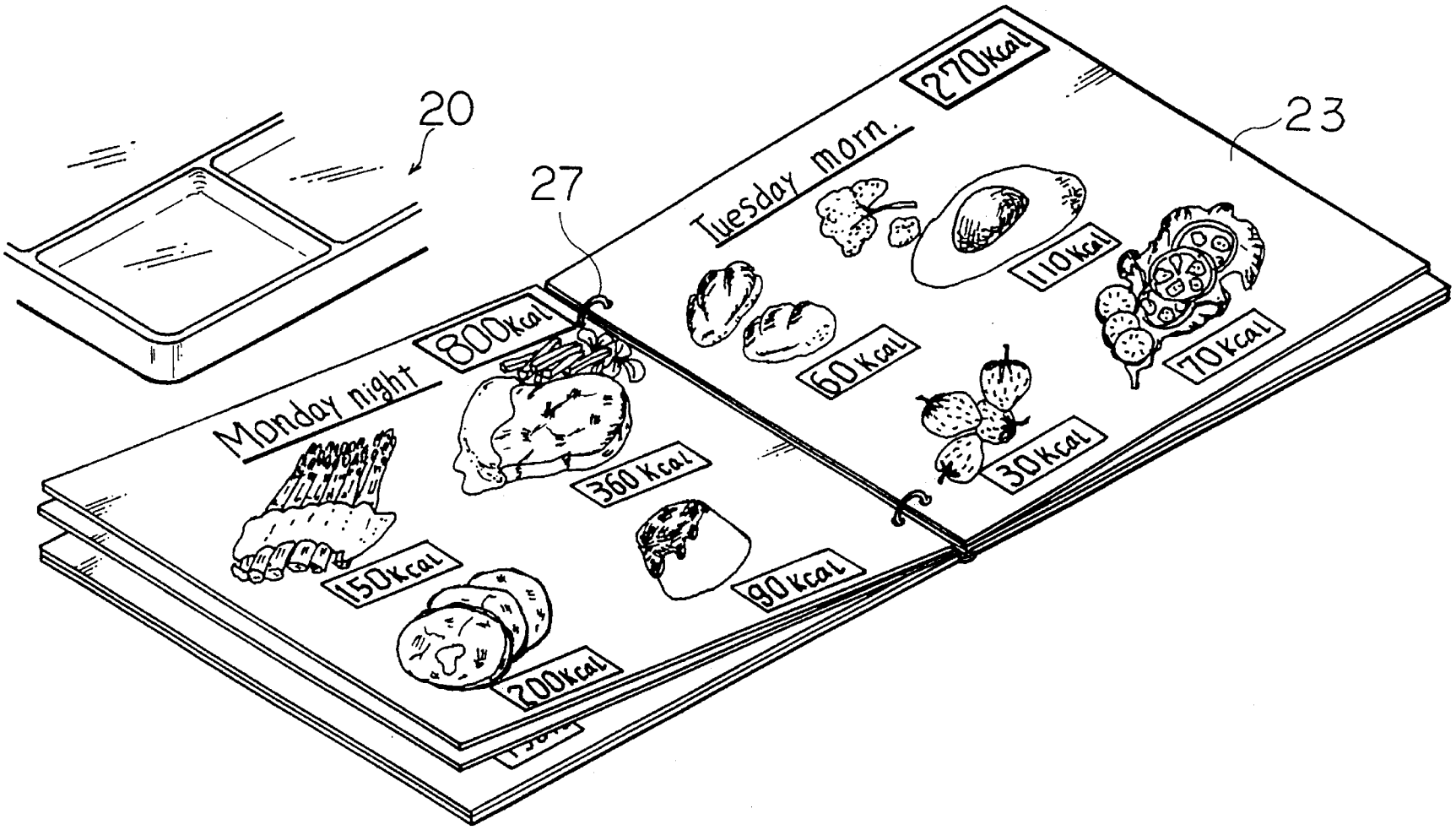

Refering to FIG. 4, various printed matter 23 is combined into a booklet and linked together at two corners by releasable rings 27 so that each printed matter can easily be released. As a result, a weekly serving menu for a dietary cure can be gathered together as a booklet.

Figure 5:
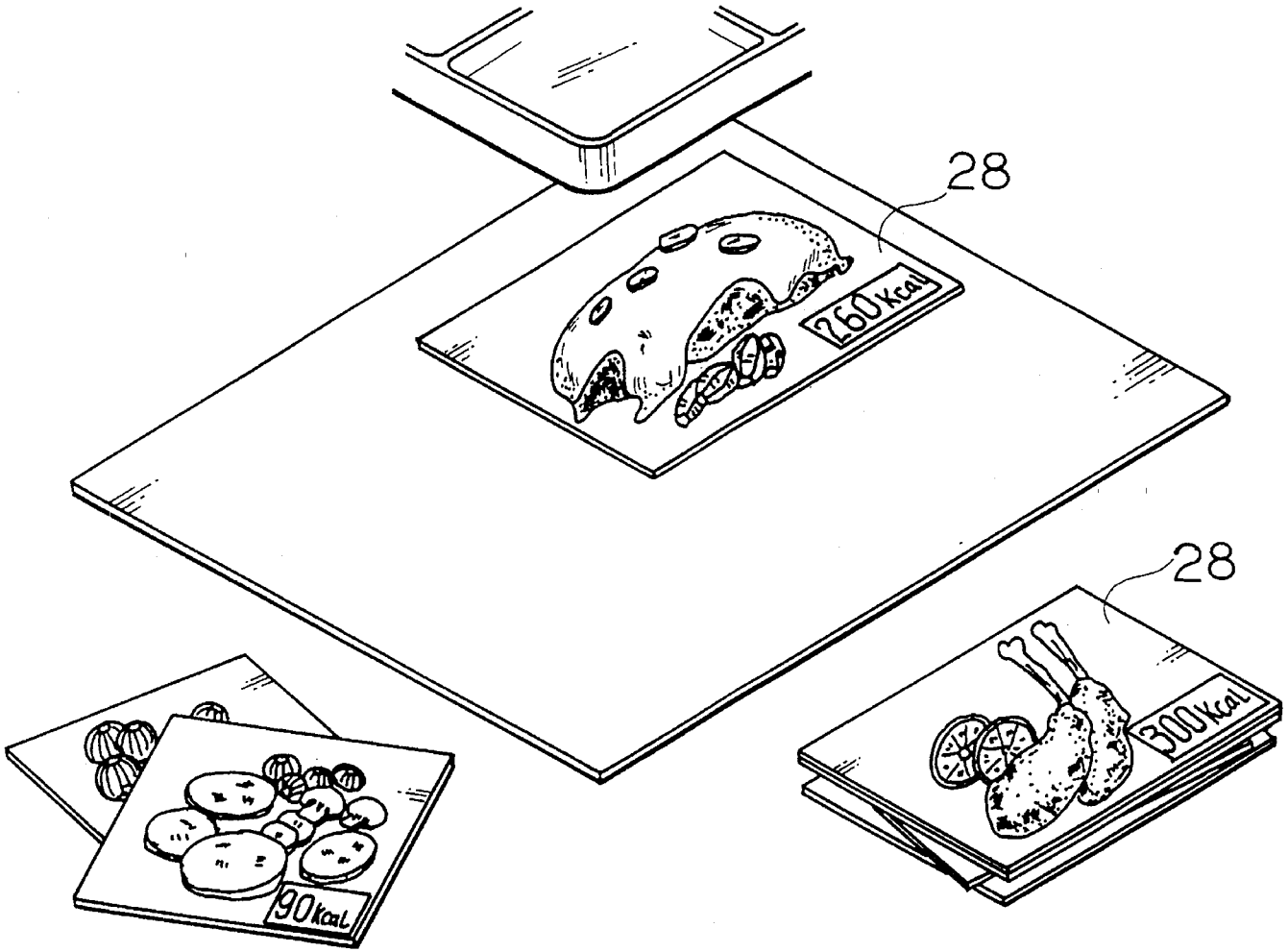
FIG. 5 is a perspective view of still another embodiment of the printed matter illustrated in FIG. 3.

Alternatively, an individual card 28 is prepared every meal as shown in FIG. 5 and then four cards are grouped and combined with the dish shown in FIG. 3. This combination can be used for a dietary cure.

The dietary dish according to the present invention may have only one actual size photograph or detailed illustration of a food such as fruit, cake, bread and the like printed on the surface. More effectively, however, the dish is formed like a tray which is divided into areas by partitions, and then actual size photographs or detailed illustrations of food are printed on the respective areas, whereby all foods per meal are printed on one dish. The number of areas is not limited and depends on the dietary menu.

If the dish is a luncheon mat made of paper as shown in FIG. 6, it can be thrown away or otherwise disposed of after the meal.

When a food is a paste or liquid such as soup, the inner wall of the dietary dish is provided with a sign to indicate the serving depth.

If the different dietary dishes according to the present invention are prepared for every meal in a day, for example, for a week, and are always used to eat all foods that have to be taken in a day, it is possible to reduce the above mentioned difficulties in a dietary cure. That is, if the dietary dish according to the present invention is used for every meal, it is possible to automatically take various nutritive components within a given number of calories without weighing foods. Further, when a patient who is required to follow a dietary cure has a meal, he is made deeply conscious of the fact that he cannot eat any foods except for foods served on the dietary dish, with the result that it can prevent him from unnecessarily eating between meals.

From the point of view of a cook, the dietary dish is also useful because it is not necessary to use a food exchange table to think about the combination of dishes. Recently seasonable vegetables and fruits are available all year round, so that it is also unnecessary to change the dietary dish every season. Of course, if so desired, the dietary dish may be prepared every season.

In the dietary dish according to the present invention comprising, in combination, printed matter and a dish having a flat and transparent bottom, it is preferable to divide the dish into areas so that foods can be placed in each areas. If the printed matter is made of paper or plastic, a great many kinds of meals can be prepared. Therefore, it is more useful to gather various printed matter and to form it into a booklet.

After the foods are placed in the dish, it may be set on a table as is. Alternatively, the served foods may be removed and placed onto an ordinary dish.

If the dietary dish having a transparent bottom is set on a table as is, designs may be given to a table covering, a table cloth and the like to make a nice presentation.

The use of the dietary dish according to the present invention is not restricted to a cure for diabetes. For instance, a diet to avoid getting fat for cosmetic purposes should essentially be the same as the cure for diabetes in treatment. Therefore, the dietary dish of the present invention can be used therefor.

There are many dietary methods, including unhealthy and dangerous ones. However, a healthy and safe dietary cure can be effected with the use of the dietary dish of the present invention.

Further, this dietary dish is applicable to various foods for various dietary cures, such as high protein and high calorie foods for chronic hepatitis, low cholesterol foods for hyperlipemia, low fat foods for chronic pancreatitis, low calcium foods for chronic renal failure, low protein foods for hyperammonia caused by cirrhosis of the liver, low salt foods for hypertension, and the like. These are chronic diseases, so that most patients suffering therefrom recuperate at home. Usually, the patient himself or his family is taught about a dietary cure in a hospital, but it is difficult for ordinary people to understand the cure in the short term. Assuming that they can understand the cure in the short term, it may fairly be said that it is impossible to cook and eat foods for a dietary cure every meal.

However, if the dietary dish of the present invention is used for the appropriate disease, it is possible to conduct a satisfactory dietary cure at home without difficulty.

As mentioned above, according to the present invention, it is possible to reduce difficulties which arise from maintaining a dietary cure over a long time, for example, difficulties in preventing nutritive elements from becoming imbalanced, in keeping to the allowed calories, in preventing a person from carelessly eating between meals, and so on.

Although the dietary dish of the present invention has been described in its preferred embodiments, it is to be understood that the invention is not limited thereto, and that various changes and modifications may be made without departing from the spirit and scope of the invention.

What is claimed is:

1. A dietary dish comprising a dish with a bottom and means for indicating an amount of food to be served, the means for indicating being located adjacent the bottom of the dish and including a photograph or illustration of the food to be served, the photograph or illustration being at least a same size as the food to be served such that an amount of the food to be served can be based on the size of the food in the photograph or illustration, the bottom of the dish being transparent and the means for indicating being placed below the dish and viewed through the transparent bottom, the means for indicating being readily removable from the bottom of the dish.

2. The dietary dish according to claim 1, wherein the means for indicating is located on a surface which is adjacent the bottom of the dish and wherein the dietary dish further includes indications of at least one of calories and main nutritive components on the surface in addition to the photograph or illustration.

3. The dietary dish according to claim 1, further comprising at least one wall adjacent the bottom of the dish, the wall having indicia for indicating a depth of food in the dish when the food to be served includes one of liquid and paste.

4. The dietary dish according to claim 3, further comprising a plurality of walls separating the dish into a plurality of sections, at least one of the sections having the indicia indicating depth of food to be served and at least one other section having the means for indicating.

5. The dietary dish according to claim 1, further comprising a plurality of walls separating the dish into a plurality of sections, the means for indicating being provided in at least one of the sections.

6. The dietary dish according to claim 5, wherein each of the sections has a photograph or illustration for indication the amount of food to be served from the respective section.

7. The dietary dish according to claim 1, wherein the bottom of the dish is flat.

8. The dietary dish according to claim 1, wherein the dish is generally circular in shape, the photograph or illustration being visible through the bottom of the dish before the food to be served is placed in the dish.

9. The dietary dish according to claim 1, wherein the means for indicating is mounted directly on the bottom of the dish.

10. The dietary dish according to claim 1, wherein the means for indicating is mounted on one of a paper sheet and a plastic sheet.

11. The dietary dish according to claim 1, wherein the means for indicating are placed on pages of a booklet with a plurality of pages, each of the pages having at least on photograph or illustration of food to be served and the pages being interchangeable with the dish such that amounts of food to be served for different meals can be indicated.

12. The dietary dish according to claim 1, wherein the means for indicating are on cards which are groupable together to illustrate a combination of foods to be served simultaneously from the dish, all of the photographs or illustrations on the cards of a group being visible through the bottom of the dish.

13. A method for determining an amount of food to be served, the method comprising the steps of:

providing a dish with a transparent bottom;

placing the dish over a photograph or illustration of the food to be served, the photograph or illustration being adjacent the bottom of the dish, the photograph or illustration being at least a same size as the food to be served and being visible through the bottom of the dish; and placing an amount of the food to be served in the dish based on the size of the food in the photograph or illustration.

14. The method according to claim 13, further comprising the step of dividing the dish into a plurality sections by providing a plurality of walls in the dish, each of the sections having a transparent bottom and each section having a photograph or illustration beneath the transparent bottom, the photograph or illustration in each section being different.

15. The method according to claim 13, further comprising the steps of:

providing at least one wall adjacent the bottom of the dish;

indicating a depth of food to be placed in the dish by indicia on the at least one wall; and placing one of a liquid and paste in the dish while measuring an amount of the one of the liquid and paste by the indicia.

16. The method according to claim 13, wherein the dish has a transparent bottom and wherein the method further comprises the steps of:

grouping the photographs or illustrations onto pages of a booklet such that a meal with a predetermined caloric amount can be indicated on each page of the booklet;

placing the dish over one of the pages of the booklet;

viewing the photographs or illustrations through the transparent bottom of the dish;

placing an amount of the food to be served in the dish based on the size of the food in each of the photographs or illustrations on the page.

* * * * *